US007740072B2

(12) United States Patent
Surjaatmadja

(10) Patent No.: US 7,740,072 B2
(45) Date of Patent: Jun. 22, 2010

(54) METHODS AND SYSTEMS FOR WELL STIMULATION USING MULTIPLE ANGLED FRACTURING

(75) Inventor: Jim B. Surjaatmadja, Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 594 days.

(21) Appl. No.: 11/545,749

(22) Filed: Oct. 10, 2006

(65) Prior Publication Data

US 2008/0083531 A1 Apr. 10, 2008

(51) Int. Cl.
*E21B 43/26* (2006.01)

(52) U.S. Cl. ..... 166/308.1; 166/177.5; 166/250.1

(58) Field of Classification Search ..... 166/308.1, 166/177.5, 250.1
See application file for complete search history.

(56) References Cited

U.S. PATENT DOCUMENTS

| | | | | | |
|---|---|---|---|---|---|
| 2,758,653 | A | * | 8/1956 | Desbrow | 175/50 |
| 2,953,460 | A | | 9/1960 | Baker | |
| 2,980,291 | A | | 4/1961 | Schuerger | |
| 3,062,286 | A | * | 11/1962 | Wyllie | 166/308.1 |
| 3,455,391 | A | | 7/1969 | Matthews et al. | 166/303 |
| 3,537,529 | A | * | 11/1970 | Timmerman | 166/271 |
| 3,682,246 | A | | 8/1972 | Closmann | 166/271 |
| 3,822,747 | A | | 7/1974 | Maguire, Jr. | 166/259 |
| 3,933,205 | A | * | 1/1976 | Kiel | 166/308.1 |
| 4,050,529 | A | * | 9/1977 | Tagirov et al. | 175/424 |
| 4,137,970 | A | | 2/1979 | Laflin et al. | 166/292 |
| 4,209,278 | A | | 6/1980 | Cooper et al. | 417/477 |
| 4,265,266 | A | | 5/1981 | Kierbow et al. | 137/101.19 |
| 4,305,463 | A | | 12/1981 | Zakiewicz | 166/245 |
| 4,353,482 | A | | 10/1982 | Tomlinson et al. | 222/1 |
| 4,409,927 | A | | 10/1983 | Loesch et al. | 122/26 |
| 4,410,106 | A | | 10/1983 | Kierbow et al. | |
| 4,427,133 | A | | 1/1984 | Kierbow et al. | |
| 4,701,095 | A | | 10/1987 | Berryman et al. | |
| 4,715,721 | A | | 12/1987 | Walker et al. | |
| 4,724,905 | A | | 2/1988 | Uhri | 166/250.1 |
| 4,733,567 | A | * | 3/1988 | Serata | 73/784 |

(Continued)

FOREIGN PATENT DOCUMENTS

| | | |
|---|---|---|
| EP | 0124251 | 11/1984 |

(Continued)

OTHER PUBLICATIONS

Office Action for U.S. Appl. No. 11/363,559 mailed Jan. 23, 2009.

(Continued)

*Primary Examiner*—Shane Bomar
(74) *Attorney, Agent, or Firm*—Robert A. Kent

(57) ABSTRACT

Methods, systems, and apparatus for inducing fractures in a subterranean formation and more particularly methods and apparatus to place a first fracture with a first orientation in a formation followed by a second fracture with a second angular orientation in the formation are provided. First and second fractures are initiated at about a fracturing location. The initiation of the first fracture is characterized by a first orientation line. The first fracture temporarily alters a stress field in the subterranean formation. The initiation of the second fracture is characterized by a second orientation line. The first orientation line and the second orientation line have an angular disposition to each other.

18 Claims, 12 Drawing Sheets

U.S. PATENT DOCUMENTS

| | | | | |
|---|---|---|---|---|
| 4,830,106 | A | 5/1989 | Uhri | 166/250.1 |
| 4,845,981 | A | 7/1989 | Pearson | |
| 4,850,750 | A | 7/1989 | Cogbill et al. | |
| 4,974,675 | A * | 12/1990 | Austin et al. | 166/250.1 |
| 5,014,218 | A | 5/1991 | Crain et al. | 700/9 |
| 5,111,881 | A * | 5/1992 | Soliman et al. | 166/250.1 |
| 5,228,510 | A | 7/1993 | Jennings, Jr. et al. | 166/263 |
| 5,245,548 | A | 9/1993 | Kuan | |
| 5,281,023 | A | 1/1994 | Cedillo et al. | 366/17 |
| 5,365,435 | A | 11/1994 | Stephenson | 700/265 |
| 5,417,283 | A | 5/1995 | Ejiogu et al. | |
| 5,494,103 | A * | 2/1996 | Surjaatmadja et al. | 166/222 |
| 5,499,678 | A * | 3/1996 | Surjaatmadja et al. | 166/298 |
| 5,515,920 | A | 5/1996 | Luk et al. | 166/280.1 |
| 5,574,218 | A | 11/1996 | Withers | |
| 5,659,480 | A | 8/1997 | Anderson et al. | 700/186 |
| 6,120,175 | A | 9/2000 | Tewell | |
| 6,193,402 | B1 | 2/2001 | Grimland et al. | 366/14 |
| 6,236,894 | B1 | 5/2001 | Stoisits et al. | |
| 6,394,184 | B2 | 5/2002 | Tolman et al. | 166/281 |
| 6,575,247 | B2 | 6/2003 | Tolman et al. | |
| 6,644,844 | B2 | 11/2003 | Neal et al. | |
| 6,729,394 | B1 | 5/2004 | Hassan et al. | |
| 6,935,424 | B2 | 8/2005 | Lehman et al. | 166/250.1 |
| 6,991,037 | B2 | 1/2006 | Hocking | |
| 7,036,587 | B2 | 5/2006 | Munoz, Jr. et al. | 166/279 |
| 7,143,842 | B2 | 12/2006 | Ikuta | 173/201 |
| 7,225,869 | B2 * | 6/2007 | Willett et al. | 166/280.1 |
| 7,243,726 | B2 | 7/2007 | Ohmer | |
| 7,367,411 | B2 | 5/2008 | Leuchtenberg | |
| 7,391,675 | B2 | 6/2008 | Drew | |
| 7,431,090 | B2 * | 10/2008 | Surjaatmadja et al. | 166/308.1 |
| 7,445,045 | B2 * | 11/2008 | East, Jr. et al. | 166/308.1 |
| 2002/0125011 | A1 * | 9/2002 | Snider et al. | 166/297 |
| 2003/0050758 | A1 | 3/2003 | Soliman et al. | |
| 2003/0141064 | A1 | 7/2003 | Roberson, Jr. | |
| 2004/0020662 | A1 | 2/2004 | Freyer | 166/387 |
| 2005/0121196 | A1 * | 6/2005 | East et al. | 166/308.1 |
| 2005/0211439 | A1 * | 9/2005 | Willett et al. | 166/308.1 |
| 2006/0081412 | A1 | 4/2006 | Wright et al. | 181/104 |
| 2006/0161358 | A1 | 7/2006 | Dykstra et al. | 702/55 |
| 2006/0185848 | A1 * | 8/2006 | Surjaatmadja et al. | 166/280.2 |
| 2006/0289167 | A1 * | 12/2006 | Surjaatmadja et al. | 166/308.1 |
| 2007/0116546 | A1 | 5/2007 | Dearing | |
| 2007/0125543 | A1 | 6/2007 | McNeel et al. | 166/308.3 |
| 2007/0125544 | A1 | 6/2007 | Robinson et al. | 166/308.3 |
| 2007/0153622 | A1 | 7/2007 | Dykstra et al. | 366/8 |
| 2007/0153623 | A1 | 7/2007 | Dykstra et al. | 366/8 |
| 2007/0153624 | A1 | 7/2007 | Dykstra et al. | 366/19 |
| 2007/0171765 | A1 | 7/2007 | Dykstra et al. | 366/19 |
| 2007/0201305 | A1 | 8/2007 | Heilman et al. | 366/141 |
| 2008/0083532 | A1 | 4/2008 | Surjaatmadja | 166/250.1 |
| 2008/0083538 | A1 * | 4/2008 | Soliman | 166/308.1 |
| 2008/0236818 | A1 | 10/2008 | Dykstra | |
| 2009/0050311 | A1 | 2/2009 | Crawford | |
| 2009/0194273 | A1 | 8/2009 | Surjaatmadja | |

FOREIGN PATENT DOCUMENTS

| | | |
|---|---|---|
| EP | 0474350 | 3/1992 |
| EP | 0508817 | 10/1992 |
| GB | 1460647 | 1/1977 |
| NO | 20042134 | 5/2004 |
| WO | WO 2004/007894 | 1/2004 |
| WO | WO 2006/109035 A | 10/2006 |
| WO | WO 2007/024383 | 3/2007 |
| WO | WO 2008/041010 A1 | 4/2008 |

OTHER PUBLICATIONS

Office Action for U.S. Appl. No. 11/873,186, dated Mar. 23, 2009.
Notice of Publication dated Apr. 10, 2008 from U.S. Appl. No. 11/753,314.
SPE 103774 "Consideration for Future Stimulation Options Is Vital in Deciding Horizontal Well Drilling and Completion Schemes for Production Optimization", 2006.
Information Disclosure Statement for U.S. Appl. No. 11/291,496, Nov. 21, 2006.
Office Action for U.S. Appl. No. 11/396,918, May 3, 2007.
Office Action for U.S. Appl. No. 11/291,496, May 3, 2007.
International Search Report for International Application No. PCT/GB2007/000677, Jun. 11, 2007.
International Search Report for International Application No. PCT/GB2007/001189, Sep. 5, 2007.
Information Disclosure Statement for U.S. Appl. No. 11/396,918, Oct. 15, 2007.
Office Action for U.S. Appl. No. 11/291,496, Oct. 16, 2007.
Information Disclosure Statement for U.S. Appl. No. 11/873,160, Oct. 16, 2007.
Information Disclosure Statement for U.S. Appl. No. 11/873,186, Oct. 16, 2007.
Office Action for U.S. Appl. No. 11/396,918, Jan. 25, 2008.
Office Action for U.S. Appl. No. 11/753,314, Jun. 12, 2008.
International Search Report for International Application No. PCT/GB2008/001044, Aug. 13, 2008.
Office Action for U.S. Appl. No. 11/291,496, Aug. 21, 2008.
Office Action for U.S. Appl. No. 11/873,186, Sep. 24, 2008.
Notice of Publication for U.S. Appl. No. 11/691,623, Oct. 2, 2008.
Warpinski, Nonnan R and Branagan, Paul T., "Altered Stress Fracturing", JPT, 990-97, 473- 476, Sep. 1989.
Surjaatmadja, "Single Point of Initiation, Dual-Fracture Placement for Maximizing Well Production," 2007 Society of Petroleum Engineers, SPE 107718, 2007.
Surjaatmadja, "The Important Second Fracture and its Operational Placement for Maximizing Production," Society of Petroleum Engineers SPE 107059, 2007.
Surjaatmadja, "The Mythical Second Fracture and its Operational Placement for Maximizing Production," Society of Petroleum Engineers SPE 106046, 2007.
Office Action for U.S. Appl. No. 11/753,314 dated Nov. 19, 2008.
Office Action for U.S. Appl. No. 11/396,918 dated Oct. 15, 2008.
Search Report and Written Opinion for International Application No. PCT/GB2008/001730, May 21, 2008.
Office Action for U.S. Appl. No. 11/291,496, dated May 19, 2009.
Office Action for U.S. Appl. No. 11/873,186, dated Oct. 5, 2009.
Office Action for U.S. Appl. No. 11/873,160, dated Oct. 1, 2009.
Office Action for U.S. Appl. No. 11/396,918, dated Apr. 29, 2009.
Office Action for U.S. Appl. No. 11/753,314, dated May 5, 2009.
Office Action for U.S. Appl. No. 11/691,623, dated Jul. 9, 2009.
Notice of Allowance for U.S. Appl. No. 11/753,314, dated Dec. 17, 2009.
Office Action for U.S. Appl. No. 11/396,918, dated Dec. 1, 2009.
Office Action for U.S. Appl. No. 11/873,186, dated Jan. 25, 2010.
Notice of Allowance for U.S. Appl. No. 11/691,623 dated Feb. 18, 2010.

* cited by examiner

METHODS AND SYSTEMS FOR WELL STIMULATION USING MULTIPLE ANGLED FRACTURING

The present invention relates generally to methods, systems, and apparatus for inducing fractures in a subterranean formation and more particularly to methods and apparatus to place a first fracture with a first orientation in a formation followed by a second fracture with a second angular orientation in the formation.

Oil and gas wells often produce hydrocarbons from subterranean formations. Occasionally, it is desired to add additional fractures to an already-fractured subterranean formation. For example, additional fracturing may be desired for a previously producing well that has been damaged due factors such as fine migration. Although the existing fracture may still exist, it is no longer effective, or less effective. In such a situation, stress caused by the first fracture continues to exist, but it would not significantly contribute to production. In another example, multiple fractures may be desired to increase reservoir production. This scenario may be also used to improve sweep efficiency for enhanced recovery wells such water flooding steam injection, etc. In yet another example, additional fractures may be created to inject with drill cuttings.

Conventional methods for initiating additional fractures typically induce the additional fractures with near-identical angular orientation to previous fractures. While such methods increase the number of locations for drainage into the wellbore, they may not introduce new directions for hydrocarbons to flow into the wellbore. Conventional method may also not account for, or even more so, utilize, stress alterations around existing fractures when inducing new fractures.

Thus, a need exists for an improved method for initiating multiple fractures in a wellbore, where the method accounts for tangential forces around a wellbore.

SUMMARY

The present invention relates generally to methods, systems, and apparatus for inducing fractures in a subterranean formation and more particularly to methods and apparatus to place a first fracture with a first orientation in a formation followed by a second fracture with a second angular orientation in the formation.

An example method of the present invention is for fracturing a subterranean formation. The subterranean formation includes a wellbore having an axis. A first fracture is induced in the subterranean formation. The first fracture is initiated at about a fracturing location. The initiation of the first fracture is characterized by a first orientation line. The first fracture temporarily alters a stress field in the subterranean formation. A second fracture is induced in the subterranean formation. The second fracture is initiated at about the fracturing location. The initiation of the second fracture is characterized by a second orientation line. The first orientation line and the second orientation line have an angular disposition to each other.

An example fracturing tool according to present invention includes a tool body to receive a fluid, the tool body comprising a plurality of fracturing sections, wherein each fracturing section includes at least one opening to deliver the fluid into the subterranean formation at an angular orientation; and a sleeve disposed in the tool body to divert the fluid to at least one of the fracturing sections while blocking the fluid from exiting another at least one of the fracturing sections.

An example system for fracturing a subterranean formation according to the present invention includes a downhole conveyance selected from a group consisting of a drill string and coiled tubing, wherein the downhole conveyance is at least partially disposed in the wellbore; a drive mechanism configured to move the downhole conveyance in the wellbore; a pump coupled to the downhole conveyance to flow a fluid though the downhole conveyance; and a computer configured to control the operation of the drive mechanism and the pump.

The fracturing tool includes tool body to receive the fluid, the tool body comprising a plurality of fracturing sections, wherein each fracturing section includes at least one opening to deliver the fluid into the subterranean formation at an angular orientation and a sleeve disposed in the tool body to divert the fluid to at least one of the fracturing sections while blocking the fluid from exiting another at least one of the fracturing sections.

The features and advantages of the present invention will be apparent to those skilled in the art. While numerous changes may be made by those skilled in the art, such changes are within the spirit of the invention.

BRIEF DESCRIPTION OF THE DRAWINGS

These drawings illustrate certain aspects of some of the embodiments of the present invention, and should not be used to limit or define the invention.

DETAILED DESCRIPTION

The present invention relates generally to methods, systems, and apparatus for inducing fractures in a subterranean formation and more particularly to methods and apparatus to place a first fracture with a first orientation in a formation followed by a second fracture with a second angular orientation in the formation. Furthermore, the present invention may be used on cased well bores or open holes.

The methods and apparatus of the present invention may allow for increased well productivity by the introduction of multiple fractures introduced at different angles relative to one another in the a wellbore.

Figure 1:
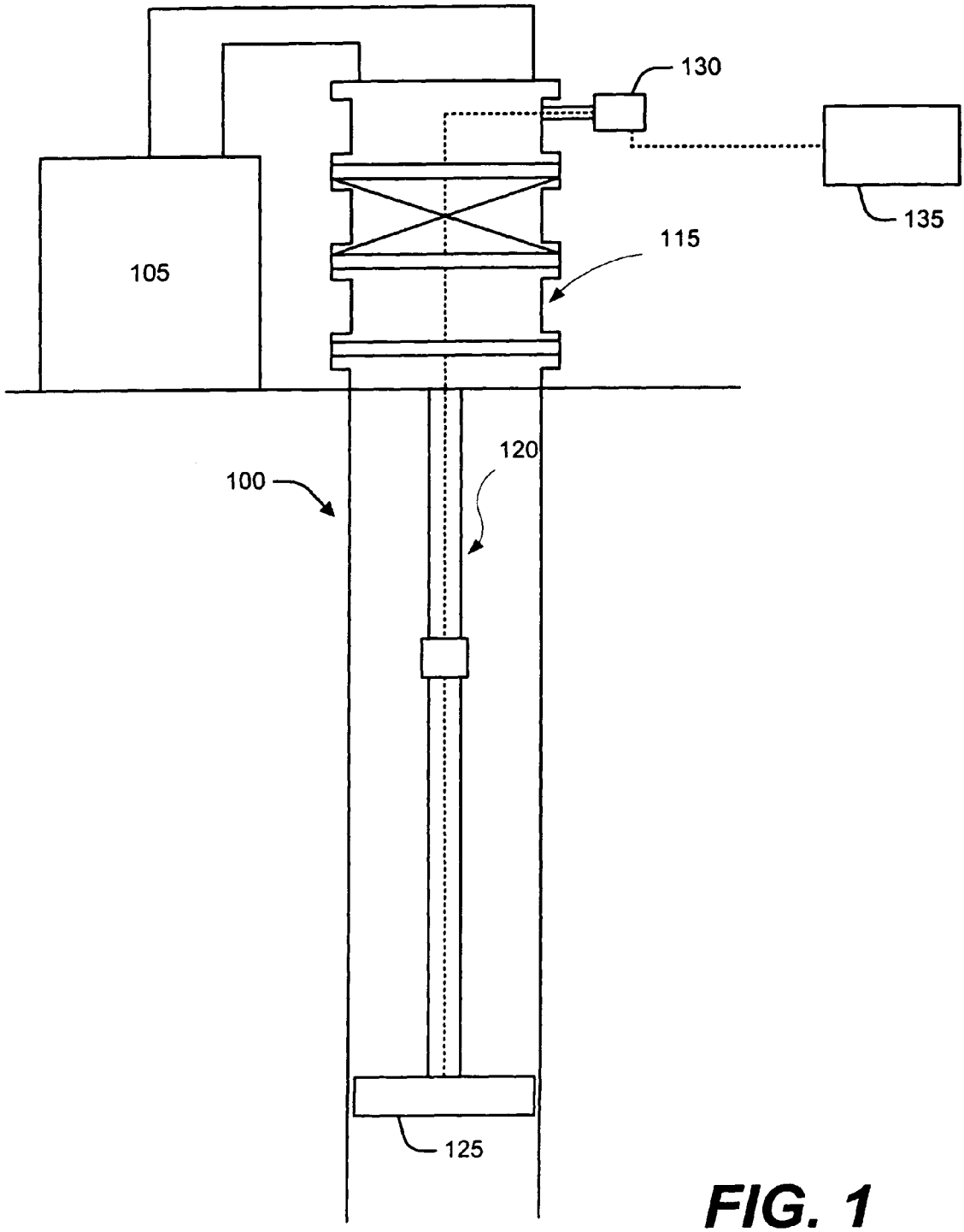
FIG. 1 is a schematic block diagram of a wellbore and a system for fracturing.

FIG. 1 depicts a schematic representation of a subterranean well bore 100 through which a fluid may be injected into a region of the subterranean formation surrounding well bore 100. The fluid may be of any composition suitable for the particular injection operation to be performed. For example, where the methods of the present invention are used in accordance with a fracture stimulation treatment, a fracturing fluid may be injected into a subterranean formation such that a fracture is created or extended in a region of the formation surrounding well bore 12 and generates pressure signals. The fluid may be injected by injection device 105 (e.g., a pump). At wellhead 115, a downhole conveyance device 120 is used to deliver and position a fracturing tool 125 to a location in the wellbore 100. In some example implementations, the downhole conveyance device 120 may include coiled tubing. In other example implementations, downhole conveyance device 120 may include a drill string that is capable of both moving the fracturing tool 125 along the wellbore 100 and rotating the fracturing tool 125. The downhole conveyance device 120 may be driven by a drive mechanism 130. One or more sensors may be affixed to the downhole conveyance device 120 and configured to send signals to a control unit 135. The control unit 135 is coupled to drive unit 130 to control the operation of the drive unit. The control unit 135 is coupled to the injection device 105 to control the injection of fluid into the wellbore 100. The control unit 135 includes one or more processors and associated data storage.

Figure 2A:
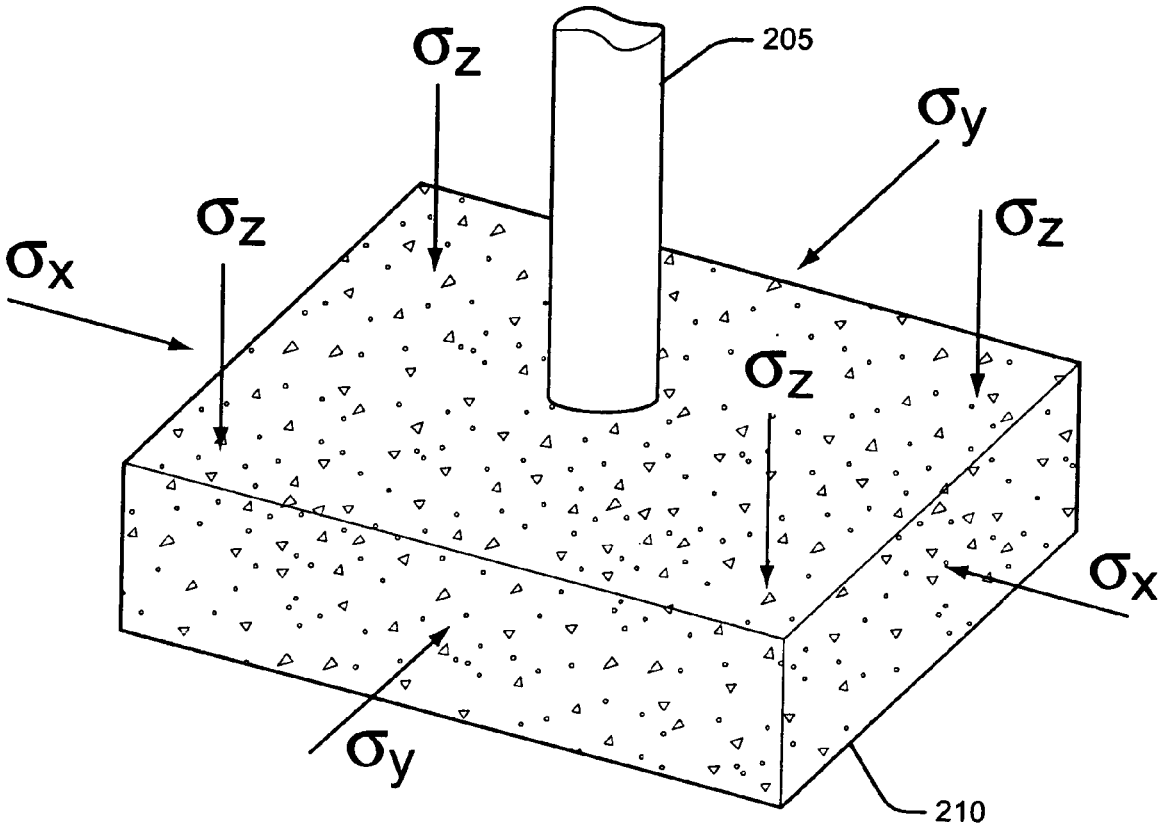
FIG. 2A is a graphical representation of a wellbore in a subterranean formation and the principal stresses on the formation.

FIG. 2 is an illustration of a wellbore 205 passing though a formation 210 and the stresses on the formation. In general, formation rock is subjected by the weight of anything above it, i.e. $\sigma_z$ overburden stresses. By Poisson's rule, these stresses and formation pressure effects translate into horizontal stresses $\sigma_x$ and $\sigma_y$. In general, however, Poisson's ratio is not consistent due to the randomness of the rock. Also, geological features, such as formation dipping may cause other stresses. Therefore, in most cases, $\sigma_x$ and $\sigma_y$ are different.

Figure 2B:
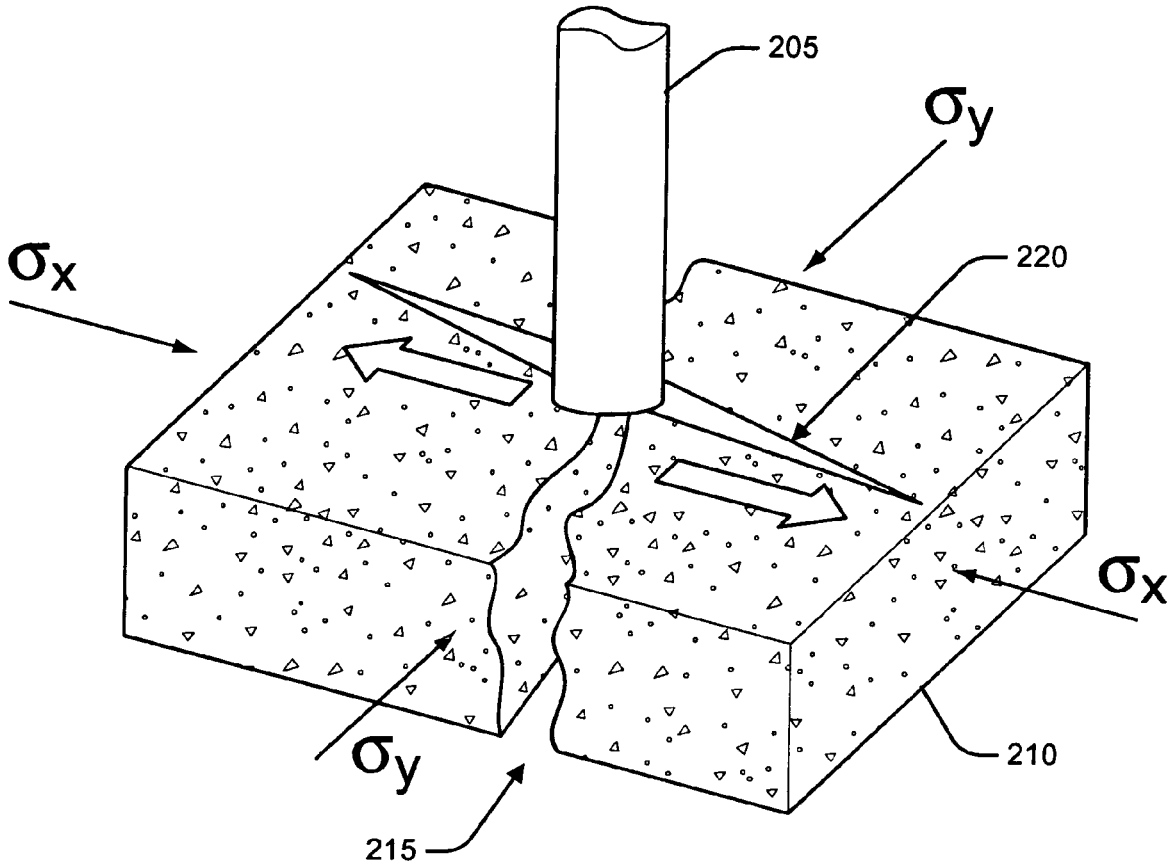
FIG. 2B is a graphical representation of a wellbore in a subterranean formation that has been fractured and the principal stresses on the formation.

FIG. 2B is an illustration the wellbore 205 passing though the formation 210 after a fracture 215 is induced in the formation 210. Assuming for this example that $\sigma_x$ is smaller than $\sigma_y$, the fracture 215 will extend into the y direction. The orientation of the fracture is, however, in the x direction. As used herein, the orientation of a fracture is defined to be a vector perpendicular to the fracture plane.

As fracture 215 opens fracture faces to be pushed in the x direction. Because formation boundaries cannot move, the rock becomes more compressed, increasing $\sigma_x$. Over time, the fracture will tend to close as the rock moves back to its original shape due to the increased $\sigma_x$. While the fracture is closing however, the stresses in the formation will cause a subsequent fracture to propagate in a new direction shown by projected fracture 220. The method, system, and apparatus according to the present invention are directed to initiating fractures, such as projected fracture 220, while the stress field in the formation 210 is temporarily altered by an earlier fracture, such as fracture 215.

Figure 3:
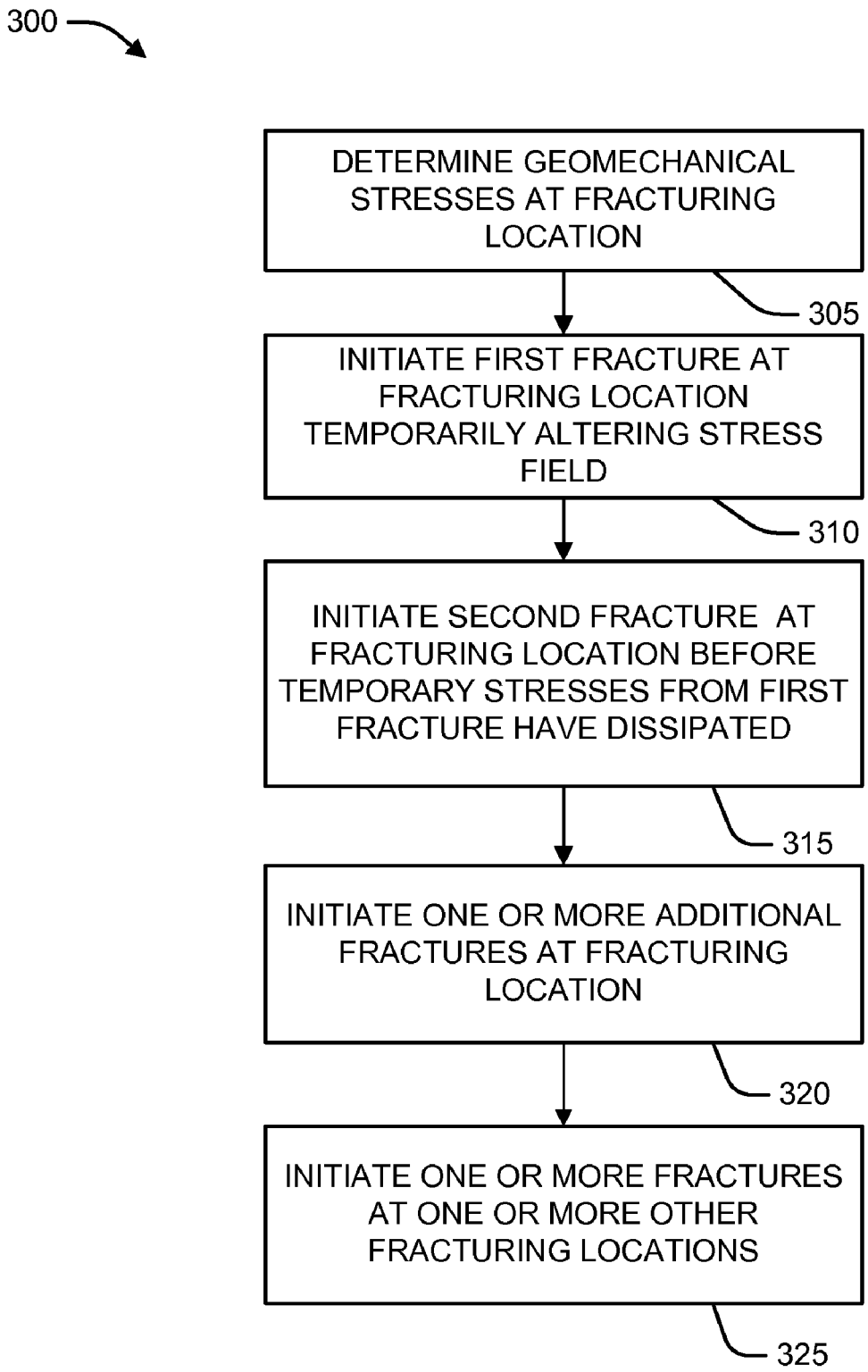
FIG. 3 is a flow chart illustrating an example method for fracturing a formation according to the present invention.

FIG. 3 is a flow chart illustration of an example implementation of one method of the present invention, shown generally at 300. The method includes determining one or more geomechanical stresses at a fracturing location in step 305. In some implementations, step 305 may be omitted. In some implementations, this step includes determining a current minimum stress direction at the fracturing location. In one example implementation, information from tilt meters or micro-seismic tests performed on neighboring wells is used to determine geomechanical stresses at the fracturing location. In some implementations, geomechanical stresses at a plurality of possible fracturing locations are determined to find one or more locations for fracturing. Step 305 may be performed by the control unit 305 by computer with one or more processors and associated data storage.

The method 300 further includes initiating a first fracture at about the fracturing location in step 310. The first fracture's initiation is characterized by a first orientation line. In general, the orientation of a fracture is defined to be a vector normal to the fracture plane. In this case, the characteristic first orientation line is defined by the fracture's initiation rather than its propagation. In certain example implementations, the first fracture is substantially perpendicular to a direction of minimum stress at the fracturing location in the wellbore.

The initiation of the first fracture temporarily alters the stress field in the subterranean formation, as discussed above with respect to FIGS. 2A and 2B. The duration of the alteration of the stress field may be based on factors such as the size of the first fracture, rock mechanics of the formation, the fracturing fluid, and subsequently injected proppants, if any. Due to the temporary nature of the alteration of the stress field in the formation, there is a limited amount of time for the system to initiate a second fracture at about the fracturing location before the temporary stresses alteration has dissipated below a level that will result in a subsequent fracture at the fracturing being usefully reoriented. Therefore, in step 315 a second fracture is initiated at about the fracturing location before the temporary stresses from the first fracture have dissipated. In some implementations, the first and second fractures are imitated within 24 hours of each other. In other example implementations, the first and second fractures are initiated within four hours of each other. In still other implementations, the first and second fractures are initiated within an hour of each other.

The initiation of the second fracture is characterized by a second orientation line. The first orientation line and second orientation lines have an angular disposition to each other. The plane that the angular disposition is measured in may vary based on the fracturing tool and techniques. In some example implementations, the angular disposition is measured on a plane substantially normal to the wellbore axis at the fracturing location. In some example implementations, the angular disposition is measured on a plane substantially parallel to the wellbore axis at the fracturing location.

In some example implementations, step 315 is performed using a fracturing tool 125 that is capable of fracturing at different orientations without being turned by the drive unit 130. Such a tool may be used when the downhole conveyance 120 is coiled tubing. In other implementations, the angular disposition between the fracture initiations is cause by the drive unit 130 turning a drillstring or otherwise reorienting the fracturing tool 125. In general there may be an arbitrary angular disposition between the orientation lines. In some example implementations, the angular orientation is between 45° and 135°. More specifically, in some example implementations, the angular orientation is about 90°. In still other implementations, the angular orientation is oblique.

In step 320, the method includes initiating one or more additional fractures at about the fracturing location. Each of the additional fracture initiations are characterized by an orientation line that has an angular disposition to each of the existing orientation lines of fractures induced at about the fracturing location. In some example implementations, step 320 is omitted. Step 320 may be particularly useful when fracturing coal seams or diatomite formations.

Figure 4:
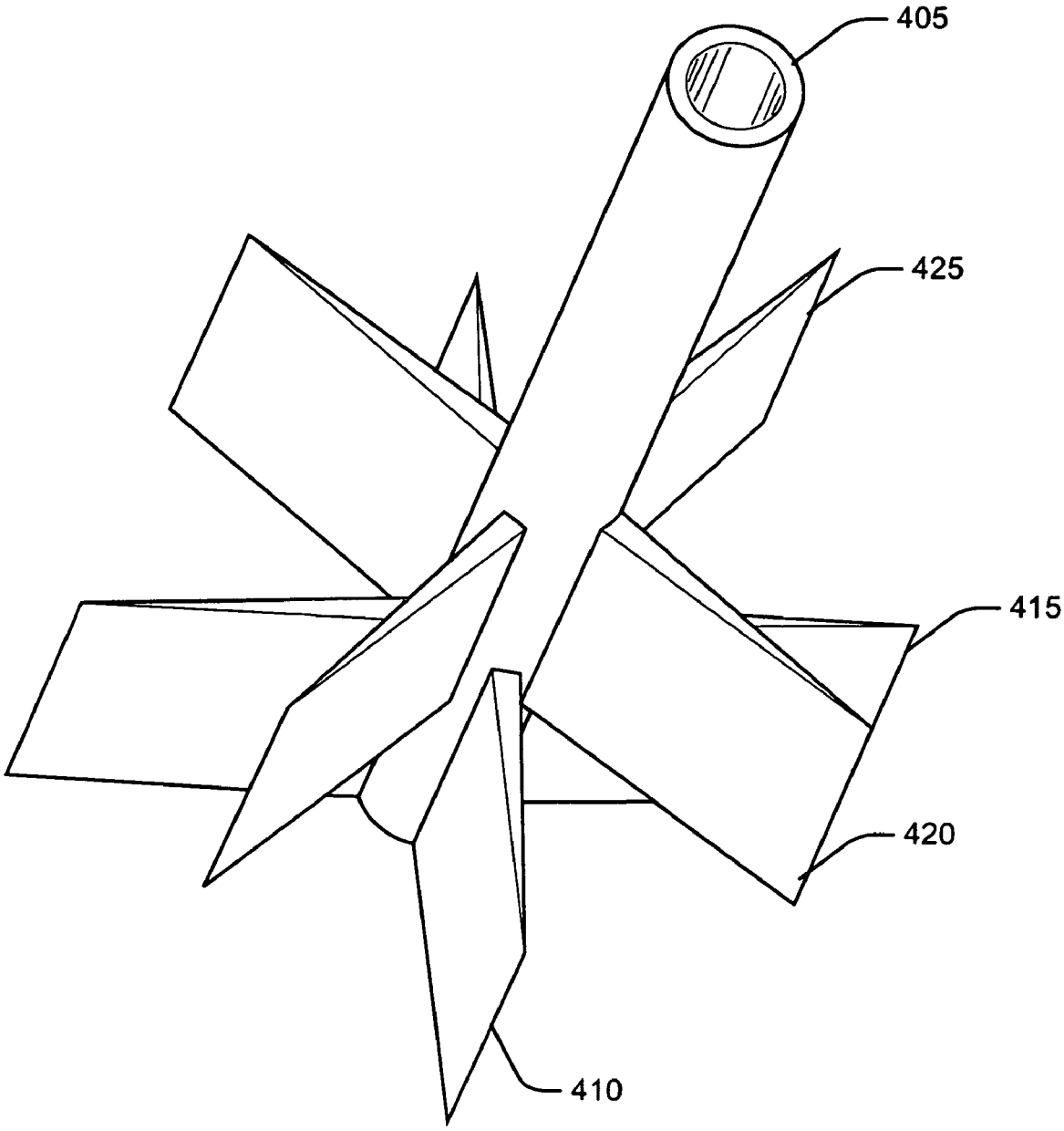
FIG. 4 is a graphical representation of a wellbore and multiple fractures at different angles and fracturing locations in the wellbore.

The fracturing tool may be repositioned in the wellbore to initiate one or more other fractures at one or more other fracturing locations in step 325. For example, steps 310, 315, and optionally 320 may be performed for one or more additional fracturing locations in the wellbore. An example implementation is shown in FIG. 4. Fractures 410 and 415 are initiated at about a first fracturing location in the wellbore 405. Fractures 420 and 425 are initiated at about a second fracturing location in the wellbore 405. In some implementations, such as that shown in FIG. 4, the fractures at two or more fracturing locations, such as fractures 410-425, and each have initiation orientations that angularly differ from each other. In other implementations, fractures at two or more fracturing locations have initiation orientations that are substantially angularly equal. In certain implementations, the angular orientation may be determined based on geomechanical stresses about the fracturing location.

Figure 5:
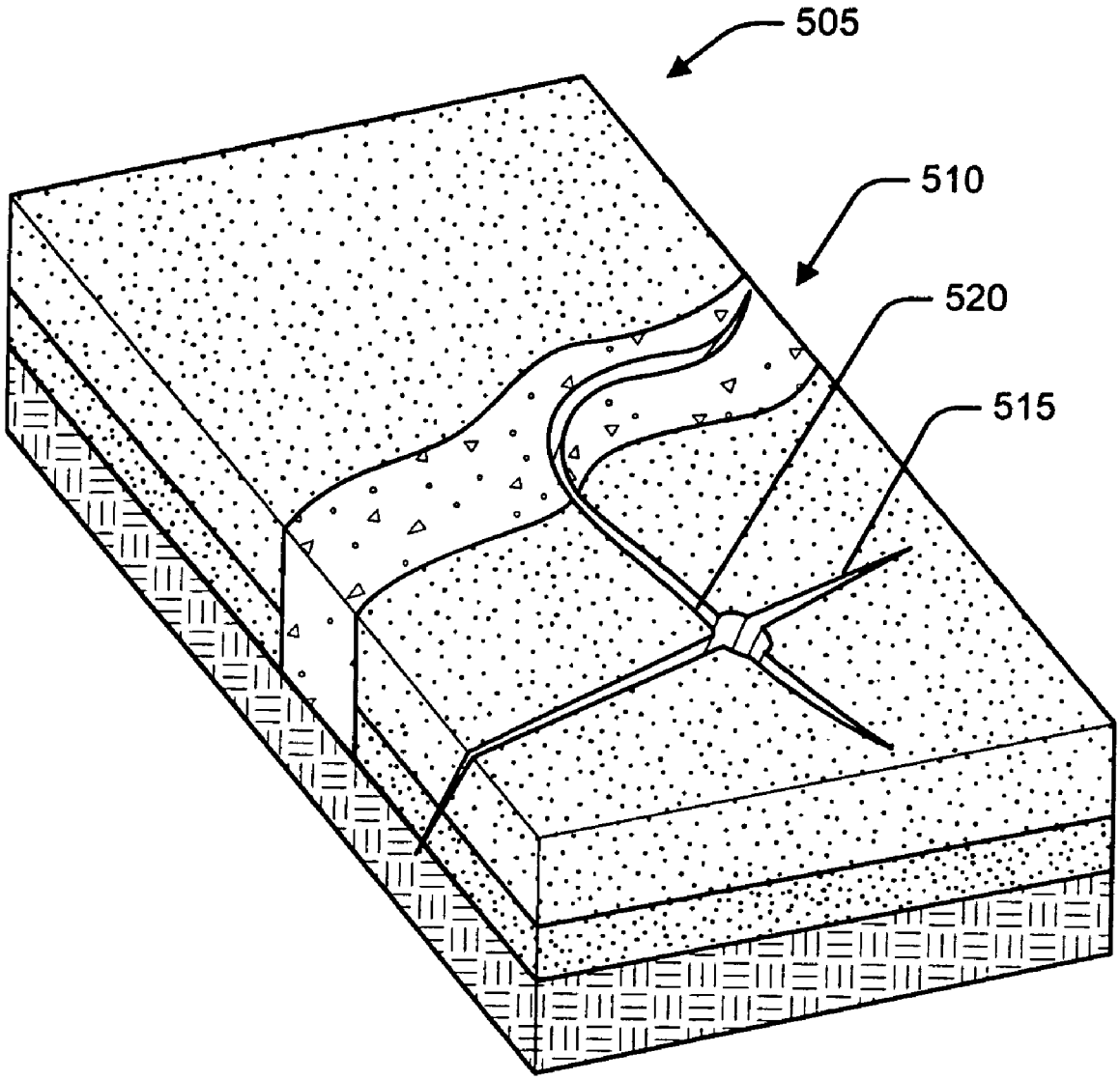
FIG. 5 is a graphical representation of a formation with a high-permeability region with two fractures.

FIG. 5 is an illustration of a formation 505 that includes a region 510 with increased permeability, relative to the other portions of formation 505 shown in the figure. When fracturing to increase the production of hydrocarbons, it is generally desirable to fracture into a region of higher permeability, such as region 510. The region of high permeability 510, however, reduces stress in the direction toward the region 510 so that a fracture will tend to extend in parallel to the region 510. In the fracturing implementation shown in FIG. 5, a first fracture 515 is induced substantially perpendicular to the direction of minimum stress. The first fracture 515 alters the stress field in the formation 505 so that a second fracture 520 can be initiated in the direction of the region 510. Once the fracture 520 reaches the region 510 it may tend to follow the region 510 due to the stress field inside the region 510. In this implementation, the first fracture 515 may be referred to as a sacrificial fracture because its main purpose was simply to temporarily alter the stress field in the formation 505, allowing the second fracture 520 to propagate into the region 510.

Figure 6:
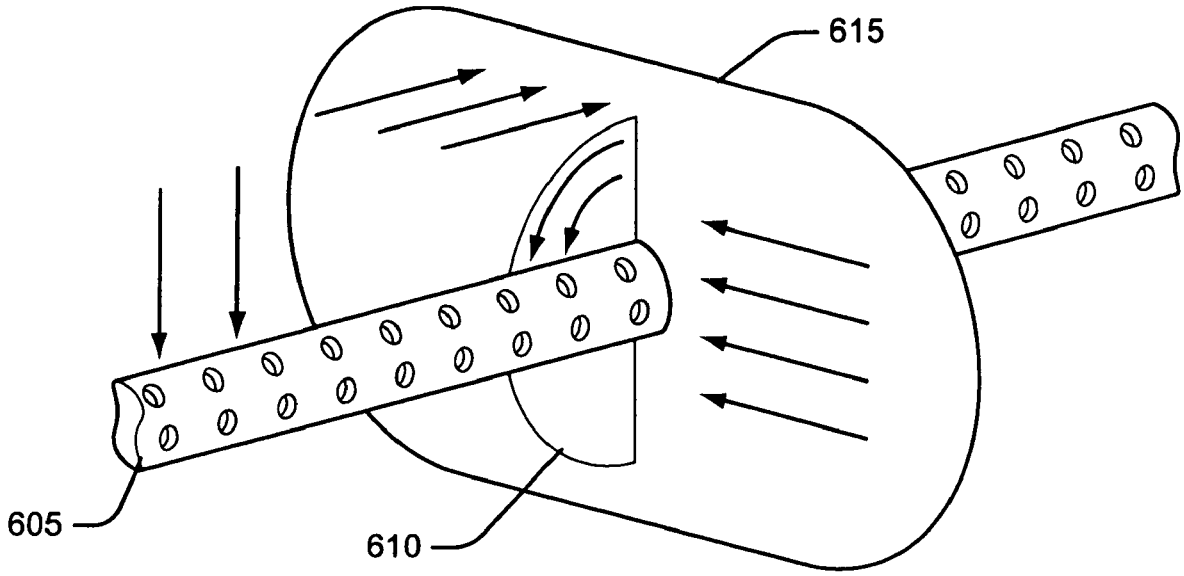
FIG. 6 is a graphical representation of drainage into a horizontal wellbore fractured at different angular orientations.

FIG. 6 illustrates fluid drainage from a formation into a horizontal wellbore 605 that has been fractured according to method 100. In this situation, the effective surface area for drainage into the wellbore 605 is increased, relative to fracturing with only one angular orientation. In the example shown in FIG. 6, fluid flow along planes 610 and 615 are able to enter the wellbore 605. In addition, flow in fracture 615 does not have to enter the wellbore radially, which causes a constriction to the fluid. FIG. 6 also shows flow entering the fracture 615 in a parallel manner; which then flows through the fracture 615 in a parallel fashion into fracture 610. This scenario causes very effective flow channeling into the wellbore.

Figure 8:
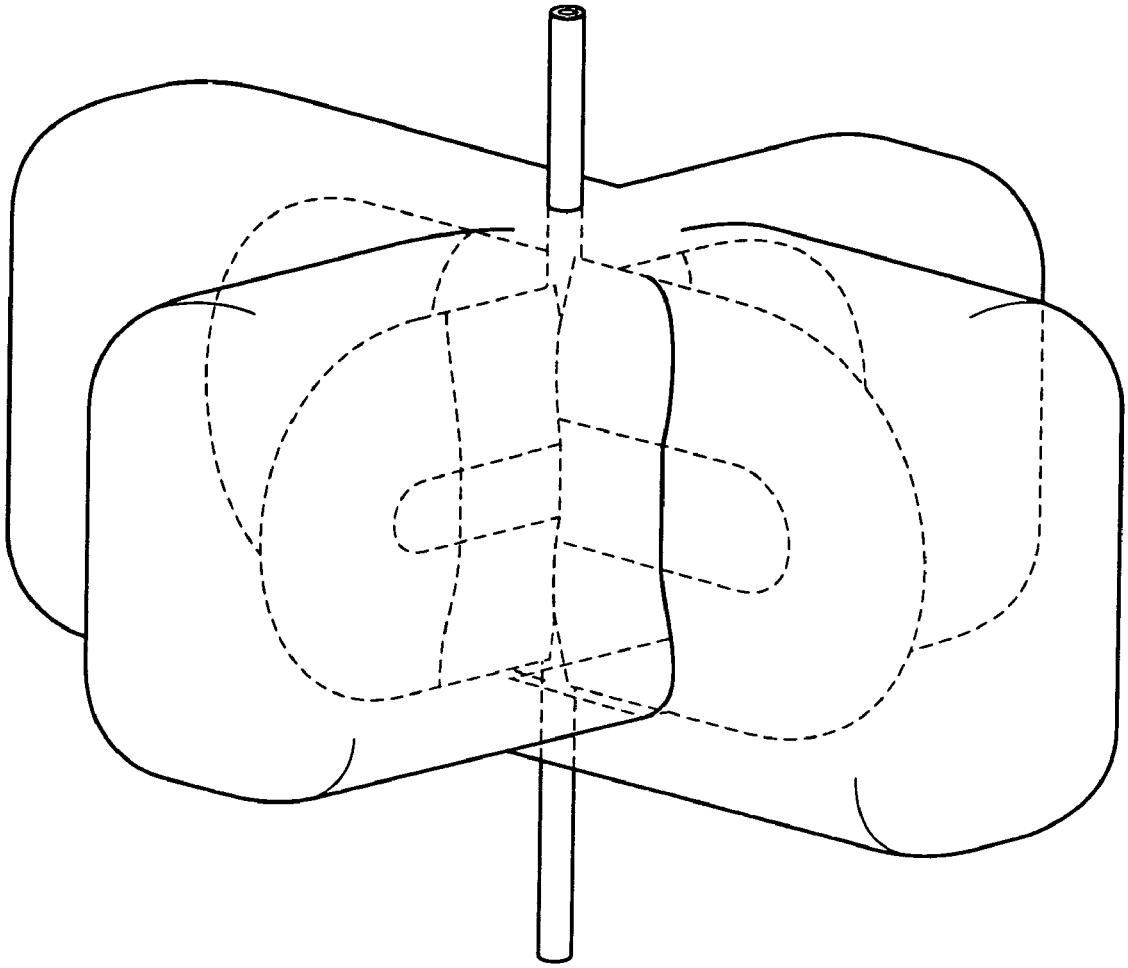
FIG. 8 is a graphical representation of the drainage of a vertical wellbore fractured at different angular orientations.

In general, additional fractures, regardless of their orientation, provide more drainage into a wellbore. Each fracture will drain a portion of the formation. Multiple fractures having different angular orientations, however, provide more coverage volume of the formation, as shown by the example drainage areas illustrated in FIG. 8. The increased volume of the formation drained by the multiple fractures with different orientations may cause the well to produce more fluid per unit of time.

Figure 7A:
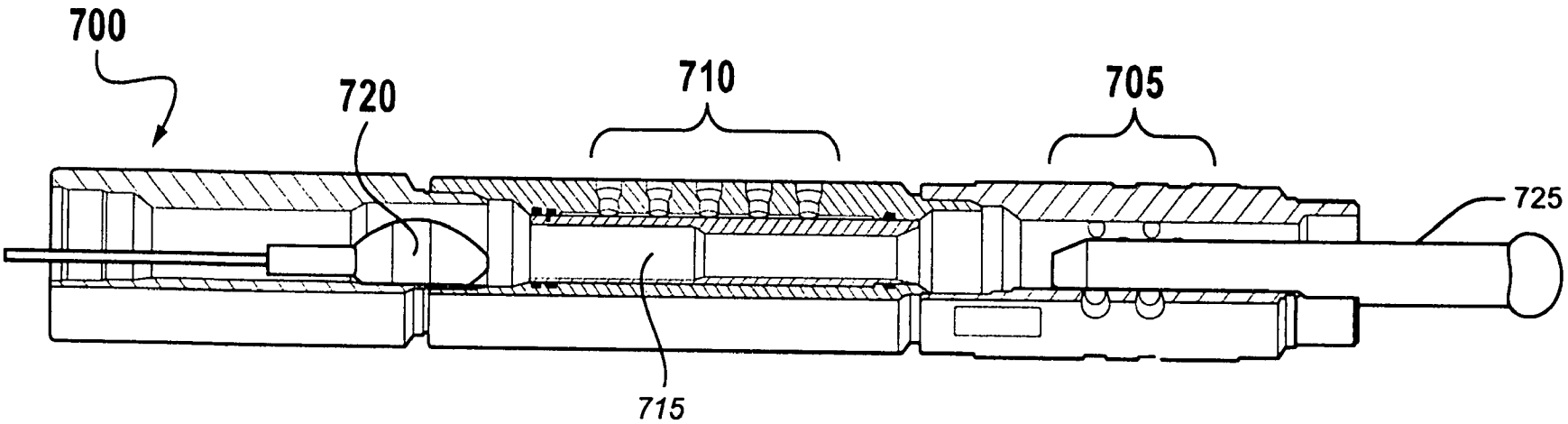
FIGS. 7A, 7B, and 7C illustrate a cross-sectional view of a fracturing tool showing certain optional features in accordance with one example implementation.
Figure 7B:
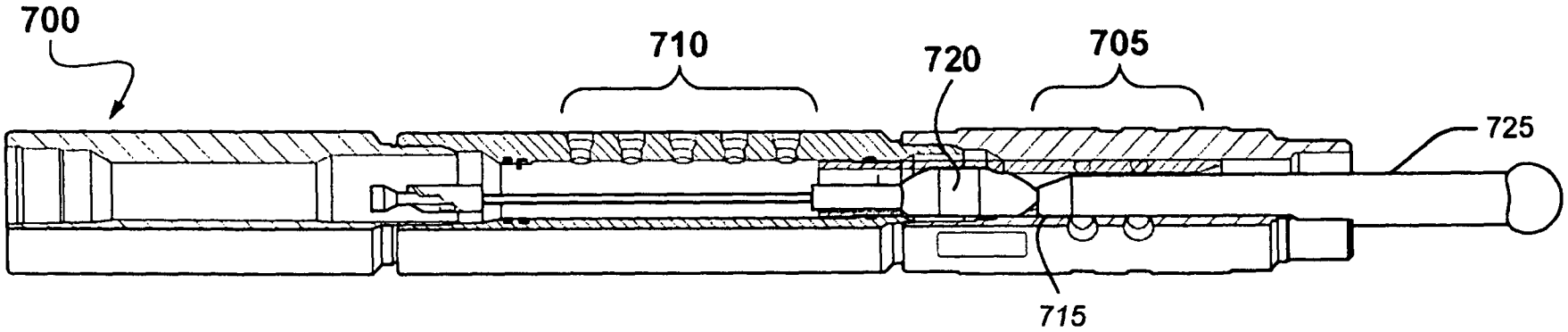
Figure 7C:
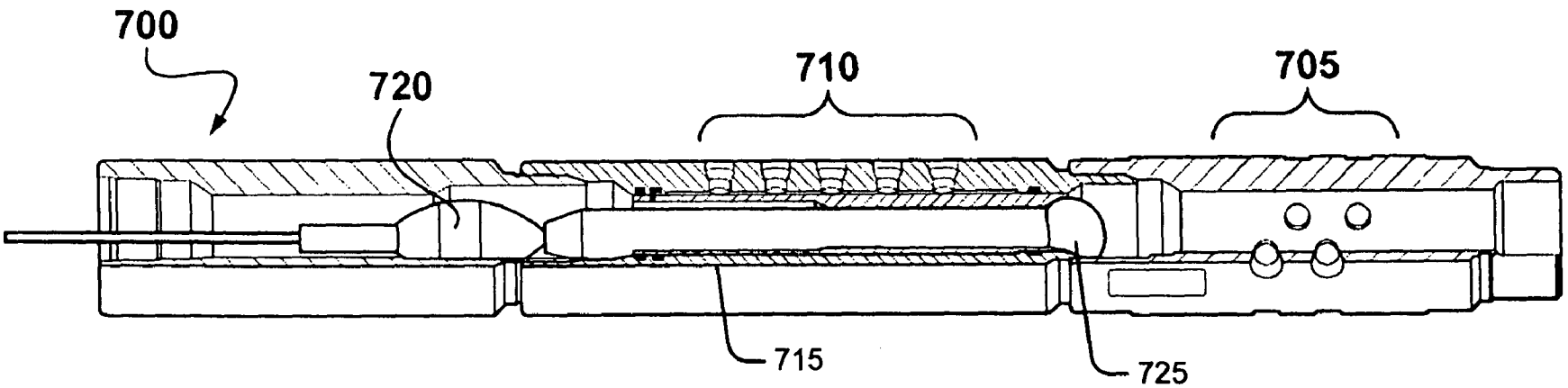

A cut-away view of an example fracturing tool 125, shown generally at 700, that may be used with method 300 is shown in FIGS. 7A-7C. The fracturing tool 700 includes at least two fracturing sections, such as fracturing sections 705 and 710. Each of sections 705 and 710 are configured to fracture at an angular orientation, based on the design of the section. In one example implementation, fluid flowing from section 710 may be oriented obliquely, such as between 45° to 90°, with respect to fluid flowing from section 705. In another implementation fluid flow from sections 705 and 710 are substantially perpendicular.

The fracturing tool includes a selection member 715, such as sleeve, to activate or arrest fluid flow from one or more of sections 705 and 710. In the illustrated implementation selection member 715 is a sliding sleeve, which is held in place by, for example, a detent. While the selection member 715 is in the position shown in FIG. 7A, fluid entering the tool body 700 exits though section 705.

A value, such as ball value 725 is at least partially disposed in the tool body 700. The ball value 725 includes an actuating arm allowing the ball valve 725 to slide along the interior of tool body 700, but not exit the tool body 700. In this way, the ball valve 725 prevents the fluid from exiting from the end of the fracturing tool 125. The end of the ball value 725 with actuating arm may be prevented from exiting the tool body 700 by, for example, a ball seat (not shown).

The fracturing tool further comprises a releasable member, such as dart 720, secured behind the sliding sleeve. In one example implementation, the dart is secured in place using, for example, a J-slot.

In one example implementation, once the fracture is induced by sections 705, the dart 720 is released. In one example implementations, the dart is released by quickly and briefly flowing the well to release a j-hook attached to the dart 725 from a slot. In other example implementations, the release of the dart 720 may be controlled by the control unit 135 activating an actuator to release the dart 720. As shown in FIG. 7B, the dart 720 causes the selection member 715 to move forward causing fluid to exit though section 710.

As shown in FIG. 7C, the ball value 725 with actuating arm may reset the tool by forcing the dart 720 back into a locked state in the tool body 700. The ball value 725 also may force the selection member 715 back to its original position, before fracturing was initiated. The ball value 725 may be force back into the tool body 700 by, for example, flowing the well.

Figure 9:
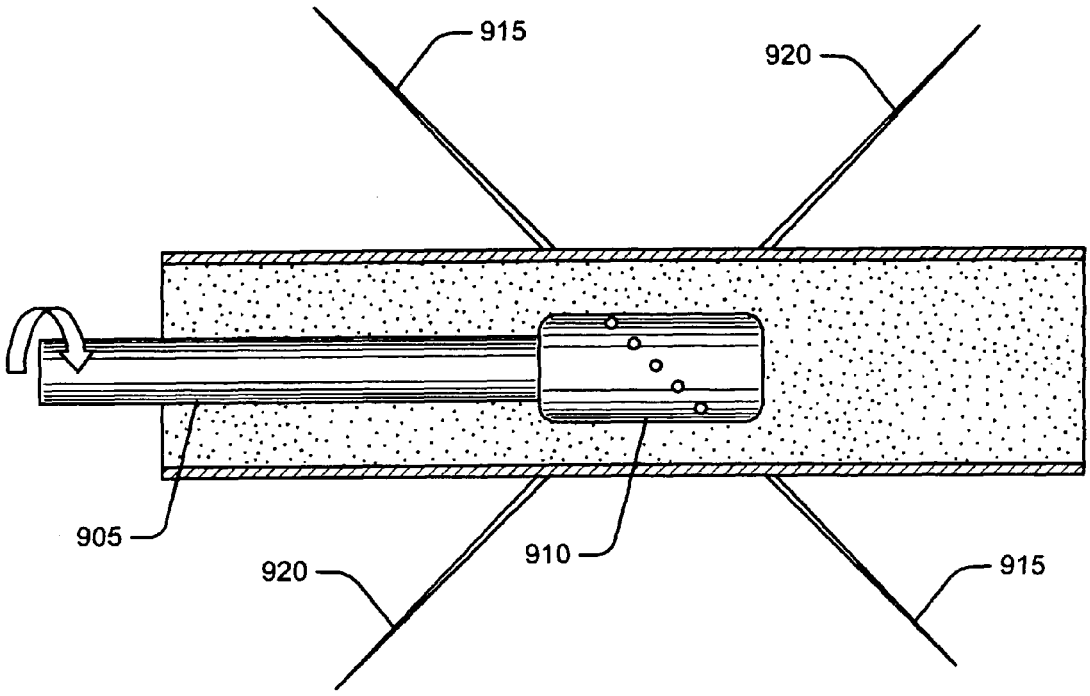
FIG. 9 is a graphical representation of a fracturing tool rotating in a horizontal wellbore and fractures induced by the fracturing tool.

Another example fracturing tool 125 is shown in FIG. 9. Tool body 910 receives fracturing fluid though a drill string 905. The tool body has an interior and an exterior. Fracturing passages pass from the interior to the exterior at an angle, causing fluid to exit from the tool body 910 at an angle, relative to the axis of the wellbore. Because of the angular orientation of the fracturing passages, multiple fractures with different angular orientations may be induced in the formation by reorienting the tool body 810. In one example implementation, the tool body is rotated to reorient the tool body to 810 to fracture at different orientations and create fractures 915 and 920. For example, the tool body may be rotate about 180°. In the example implementation shown in FIG. 9 where the fractures 915 and 920 are induced in a horizontal or deviated portion of a wellbore, the drill string 805 may be rotate more than the desired rotation of the tool body 910 to account for friction.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present invention. Also, the terms in the claims have their plain, ordinary meaning unless otherwise explicitly and clearly defined by the patentee.

What is claimed is:

1. A method for fracturing a subterranean formation, wherein the subterranean formation comprises a wellbore having an axis, the method comprising:

providing a fracturing tool that is configured to receive a fluid and deliver the fluid into the subterranean formation;

inducing a first fracture in the subterranean formation, wherein:

the first fracture is initiated at about a fracturing location, the initiation of the first fracture is characterized by a first orientation line, and the first fracture temporarily alters a stress field in the subterranean formation; and inducing a second fracture in the subterranean formation, wherein:

the second fracture is initiated at about the fracturing location, the initiation of the second fracture is characterized by a second orientation line, and the first orientation line and the second orientation line have an angular disposition to each other.

2. The method of claim 1, wherein the second fracture is initiated before the dissipation of the temporary alteration of the stress field in the subterranean formation at the fracturing location due to the first fracture.

3. The method of claim 1, wherein the second fracture is initiated no later than twenty-four hours after the first fracture is initiated.

4. The method of claim 1, wherein the second fracture is initiated no later than four hours after the first fracture is initiated.

5. The method of claim 1, wherein the angular disposition is between 45°-135°.

6. The method of claim 1, wherein the angular disposition is about 90 °.

7. The method of claim 1, further comprising:

determining a set of geomechanical stresses at the fracturing location in the wellbore and wherein the first orientation line and second orientation line are chosen based, at least in part, on the set of geomechanical stresses.

8. The method of claim 1, wherein the first fracture is substantially perpendicular to a direction of minimum stress at the fracturing location in the wellbore.

9. The method of claim 1, further comprising:

inducing a third fracture in the subterranean formation, wherein:

the third fracture is initiated at about a second fracturing location, the initiation of the third fracture is characterized by a third orientation line, and the third fracture temporarily alters a stress field in the subterranean formation; and inducing a fourth fracture in the subterranean formation, wherein:

the fourth fracture is initiated at about the second fracturing location, the initiation of the fourth fracture is characterized by a fourth orientation line, and the third orientation line and the fourth orientation line have an angular disposition to each other.

10. The method of claim 1, further comprising:

inducing at least one additional fracture, wherein:

the at least one additional fracture is initiated at about the fracturing location;

the initiation of the at least one additional fracture is characterized by an additional orientation line, and the additional orientation line differs from both the first orientation line and the second orientation line.

11. The method of claim 1, wherein the fracturing tool comprises a plurality of sections, each comprising at least one opening to deliver the fluid into the formation at an orientation and a sleeve to divert the fluid to at least one of the plurality of sections.

12. A method for fracturing a subterranean formation, wherein the subterranean formation comprises a wellbore having an axis, the method comprising:

providing a fracturing tool that is configured to receive a fluid and deliver the fluid into the subterranean formation;

inducing a first fracture in the subterranean formation, wherein:

the first fracture is initiated at about a fracturing location, the initiation of the first fracture is characterized by a first orientation line, and the first fracture temporarily alters a stress field in the subterranean formation; and inducing a second fracture in the subterranean formation, wherein:

the second fracture is initiated at about the fracturing location, the initiation of the second fracture is characterized by a second orientation line, and the first orientation line and the second orientation line have an angular disposition to each other;

wherein the fracturing tool comprises a tool body to receive a fluid, the tool body comprising an interior, an exterior surface, and a set of passages from the interior to the exterior surface to release the fluid into the subterranean formation, wherein each passage has an oblique orientation to the exterior surface where the passage interrupts the exterior surface, the method further comprising:

causing the angular disposition between the first orientation line and the second orientation line by repositioning the tool body before inducing the second fracture in the subterranean formation.

13. The method of claim 12, wherein the tool body is coupled to a drill string, wherein repositioning the tool body comprises:

rotating the drillstring.

14. The method of claim 1, wherein the provided fracturing tool further comprises:

a releasable member releasably disposed in a body of the tool, that when released, advances a sleeve so that the fluid is diverted to a next one of a plurality of sections.

15. The method claim 14, where the releasable member comprises a dart.

16. The fracturing tool of claim 14, wherein the releasable member is attached to the interior of the tool body by a J-slot.

17. The method claim 1, wherein the provided fracturing tool comprises:

a ball valve comprising an actuating arm, wherein the ball valve is slideably disposed in one end of a body of the tool.

18. The method of claim 17, wherein the ball valve is configured to reset the fracturing tool by moving a sleeve to an initial position and moving a releasable member back to a locked position.

* * * * *